United States Patent [19]

Leveque de Vilmorin

[11] Patent Number: 4,512,583

[45] Date of Patent: Apr. 23, 1985

[54] GOLF CLUB FOR INSTRUCTION OR RECREATION

[76] Inventor: Laurent Leveque de Vilmorin, 15 rue Pierre Lescot, Paris, France, 75001

[21] Appl. No.: 552,536

[22] Filed: Nov. 16, 1983

[30] Foreign Application Priority Data

Nov. 17, 1982 [FR] France ..... 82 19250

[51] Int. Cl.[3] ..... A63B 53/04

[52] U.S. Cl. ..... 273/168; 273/167 J

[58] Field of Search ..... 273/168, 79, 162 R, 273/167 R, 167 J, 168, 193 B; D21/214

[56] References Cited

U.S. PATENT DOCUMENTS 137,863 5/1944 Jakosky ..... D21/214
2,336,405 12/1943 Kent ..... 273/79
3,204,962 9/1965 McCormick ..... 273/80.1
3,416,798 12/1968 Pennington ..... 273/80
3,836,153 9/1974 Dance, Jr. ..... 273/173

*Primary Examiner*—Richard C. Pinkham
*Assistant Examiner*—Vincent A. Mosconi
*Attorney, Agent, or Firm*—Beveridge, DeGrandi and Weilacher

[57] ABSTRACT

A golf club has a shaft and a head for striking the ball, wherein the head has a generally polyhedral external shape widening out from the shaft. The head has at least three striking faces which have different angles of inclination and can be selected by turning the shaft. Beyond the striking faces, the head preferably has a generally flattened polyhedral shape with faces which support the head on the ground when using the different selectable striking faces.

17 Claims, 18 Drawing Figures

GOLF CLUB FOR INSTRUCTION OR RECREATION

It is known that the game of golf proper needs large courses, training by a coach, and the purchase of equipment comprising in particular a substantial number of various clubs (fourteen being authorized in competitions)-all points which constitute so many selection factors which slow down the development of a game of this kind, even taking into account the ever increasing interest which it arouses.

From U.S. Pat. No. 3,416,798 a golf club is already known whose striking head has two striking faces which can be used alternatively and can be selected by simply turning the shaft. The striking head has a generally cylindrical shape, the two faces, which have different slopes, being formed by two planes intersecting the cylinder and forming different angles in relation to the generatrices of the cylinder. The striking faces do not intersect on the striking head, the top of which has the previously mentioned substantially cylindrical shape.

An arrangement of this kind resembles the construction already in use for mallets of cylindrical shape, which have one flat face and one curved face, as described for example in French Pat. No. 836,949.

However, a construction of this kind has the disadvantage that it does not by itself make it possible to play golf or an outdoor game similar to golf. A game of this kind in fact requires at least three clubs having different characteristics. The first is used for driving the ball to a great distance with the aid of a slightly inclined striking face, which lifts the ball only slightly and imparts the essential part of its kinetic energy in a substantially horizontal direction. The second must be able to lift the ball and must have a sharply inclined face so that the kinetic energy is divided between the vertical direction and the horizontal direction. Finally, it is necessary to have a third club available for causing the ball to roll without being lifted.

It is for this reason that the club described in U.S. Pat. No. 3,416,798 cannot be used alone, because it has only two striking faces and must therefore be considered as a simple accessory which can at most reduce the number of clubs required.

The present invention seeks to provide a club for an instructive game of golf or recreational game which obviates these disadvantages and makes it possible to dispose, on a single striking head integral with the shaft, three faces which respectively make it possible to roll the ball over a short distance, to drive the ball to a great distance while causing it to travel through a low trajectory corresponding to an intermediate iron or No. 3 wood and to send the ball to a short distance by causing it to follow a high trajectory, these different utilizations being selected by simply turning the shaft.

The present invention also has as an object a club for an instructive recreational game similar to golf which is intended by itself to permit all the essential strokes which can be played with the usual set of golf clubs, and which, while being used with a ball which is easy to find on ordinary land, which may or may not be grassy but which is relatively clear, and with ranges shorter than those possible in golf, makes it possible to create a game of the golf type without requiring a comparable specific surface or course, so that it can make available to everyone an instructive or recreational game at incomparably lower cost, which game could be called "wild golf".

The golf club for instruction or recreation according to the invention comprises a shaft and a striking head of generally polyhedral shape widening out from the shaft and having a plurality of striking faces which have different angles of inclination and can be selected by simply turning the shaft. According to the invention, the striking head has three striking faces widening out in trihedral form from an apex on which the shaft of the club is fixed, the three faces being separated by three edges which intersect at the end of the shaft fastened to the striking head.

The striking head has in addition at least two faces for support on the ground, which are separated by at least one edge, the said faces for support on the ground extending beyond the striking faces. The faces for support on the ground are such that the shaft forms an angle between 60 and 75 degrees relative to a horizontal plane when they are respectively in contact with the ground.

The first striking face is substantially vertical when the associated face for support on the ground is in contact with the ground. It then serves to roll the ball over short distances, and corresponds to the golf club known as a putter.

The same substantially vertical striking support face can be used for driving the ball to a great distance with a tight trajectory, provided that the ball, before being struck, is placed on a suitable support, so that the ball is situated about 3 centimeters from the ground. It is then not necessary for the striking head to have a support face resting on the ground. In this type of utilization, the club according to the invention is used like the golf club known as a driver.

It will be recalled that the characteristics of a golf club comprise in particular two angles defining the inclination of the shaft and the backward slope of the striking face. The angle formed by the shaft in relation to the horizontal is thus called "lie". In the same way, the angle of backward slope of the striking face relative to the vertical line passing through the shaft is called "loft".

When the first striking face of the club according to the invention is used as just stated, in the manner of a driver, the lie may advantageously be between 50 and 60 degrees, while the loft is preferably between 8 and 12 degrees.

When its associated face for support on the ground is in contact with the ground, the second striking face has an angle of backward slope or loft preferably between 25 and 35 degrees. The inclination of the shaft, or lie, is then between 60 and 75 degrees. The utilization of this second striking face therefore makes it possible to dispatch the ball a relatively great distance by giving it a low trajectory. This utilization may for example advantageously correspond to that of a golf club known as "No. 3 wood" or of an "intermediate iron".

When its associated face for support on the ground is in contact with the ground, the third striking face has an angle of backward slope or loft between 40 and 45 degrees. The inclination of the shaft, or lie, is between 60 and 75 degrees, as previously.

It will be noted that the inclination of the shaft is preferably substantially the same when the second and third striking faces of the club according to the invention are used.

The utilization of the third striking face makes it possible to send the ball a short distance by giving it a high trajectory. This utilization corresponds substantially to that of a golf club known as "No. 9 iron".

In a first embodiment the striking head comprises three faces for support on the ground which substantially form a trihedron which is flatter than that formed by the three striking faces.

In another embodiment the striking head comprises only two faces for support on the ground, of which one is substantially triangular in shape, the other being substantially rectangular.

In this last-mentioned embodiment the faces for support on the ground and the second and third striking faces are disposed in such a manner that the edge between the striking face used and the support face in contact with the ground is substantially parallel to the trace of the shaft on the ground whichever striking face is used.

One of the support faces is disposed in such a manner that the first striking face forms an angle of from 5 to 20 degrees with a vertical plane when the aforesaid support face is in contact with the ground, the edge between the said support face and the first striking face being substantially at right angles to the trace of the shaft on the ground when the club is in use. It will be understood that this utilization then resembles that of a putter.

The same support face is in contact with the ground both during the utilization of the third striking face, which has the greatest inclination, and during the utilization of the first striking face, which is substantially vertical after appropriate rotation of the shaft. In this embodiment, one of the faces for support on the ground is therefore used in association with two striking faces.

The invention will be better understood with the aid of the detailed description of two embodiments, which is given entirely without constituting a limitation and which is illustrated by the accompanying drawings, in which.

Figure 9:
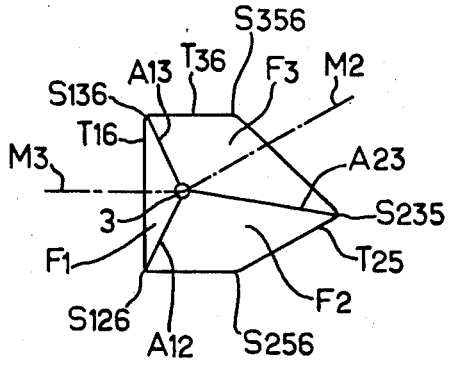
FIG. 9 is a top view, similar to FIG. 1, of another form of construction of a club according to the invention.
Figure 10:
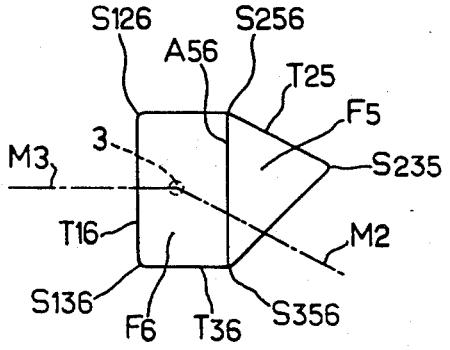
FIG. 10 is a view taken from below of the club shown in FIG. 9, showing the two faces for support on the ground.
Figure 11A:
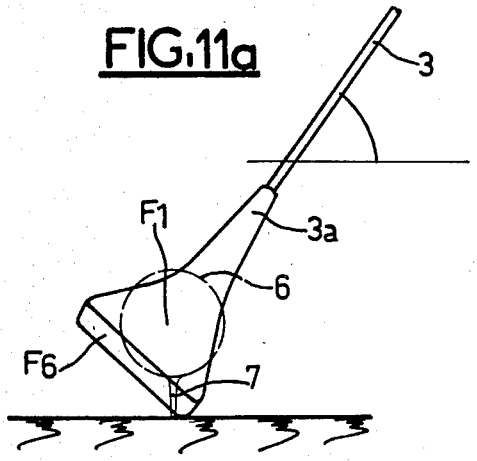
Figure 11B:
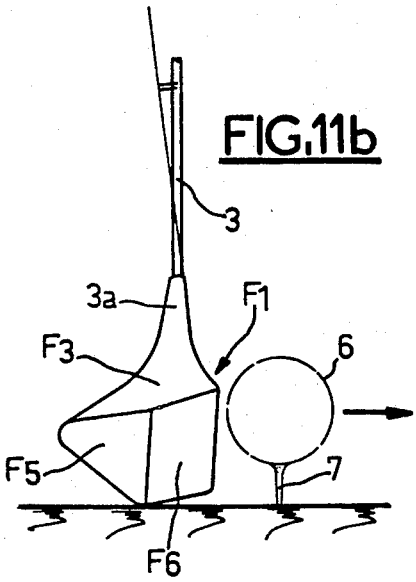
Figure 12A:
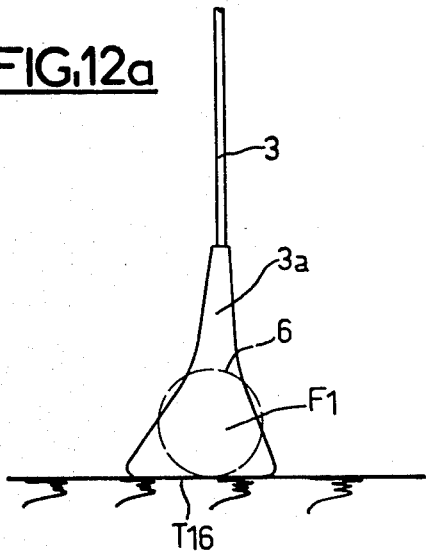
Figure 12B:
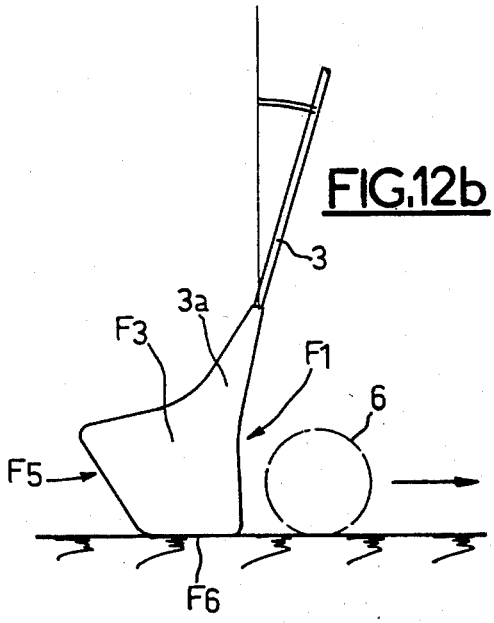
Figure 13A:
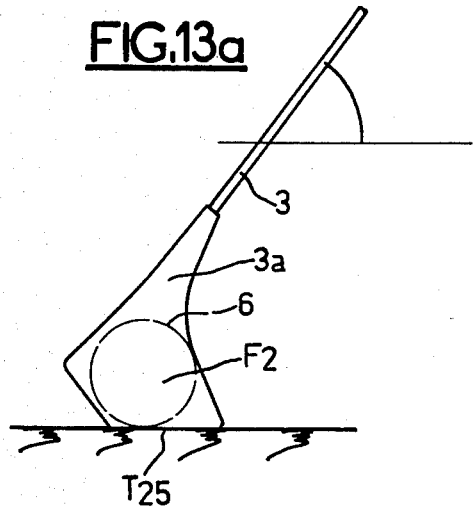
Figure 13B:
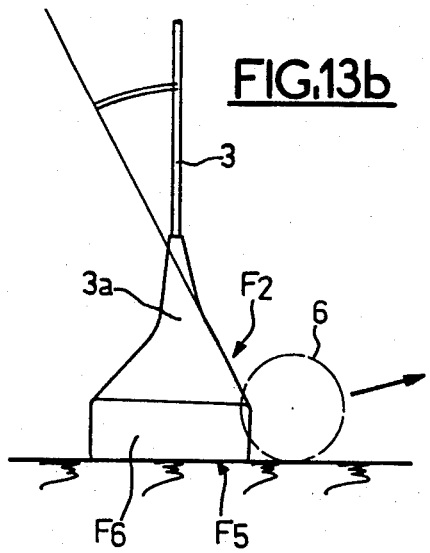
Figure 14A:
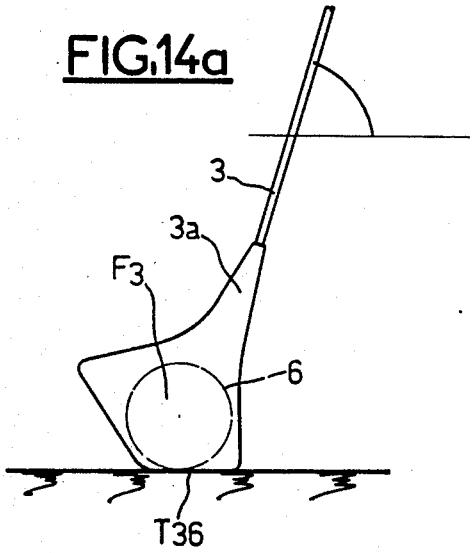
Figure 14B:
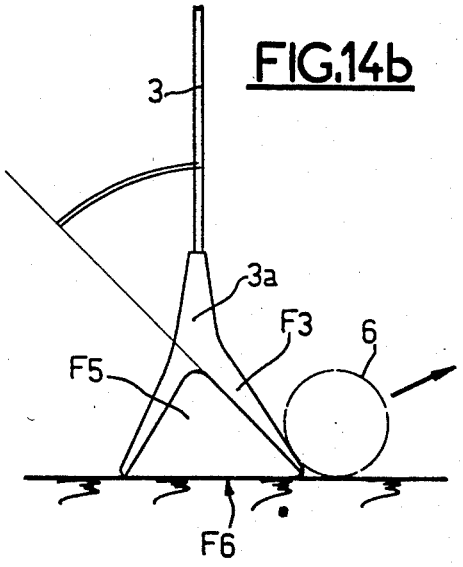

FIGS. 11*a* and 11*b* show the utilization of the club shown in FIGS. 9 and 10 for driving the ball a great distance after it has been placed on a support, as with a driver. FIG. 11*a* shows the club with the trajectory perpendicular to the plane of the Figure, while FIG. 11*b* shows the same position with the trajectory in the plane of the Figure;

FIGS. 12*a* and 12*b* show, similarly to FIGS. 11*a* and 11*b*, the utilization of the club for causing the ball to roll, after the style of a putter;

FIGS. 13*a* and 13*b* show, like the preceding Figures, the utilization of the club for sending the ball by imparting to it a low trajectory, as with a No. 3 wood or an intermediate iron, and FIGS. 14*a* and 14*b* show, like the preceding Figures, the utilization of the club for sending the ball by imparting to it a high trajectory, after the style of a No. 9 iron.

Figure 1:
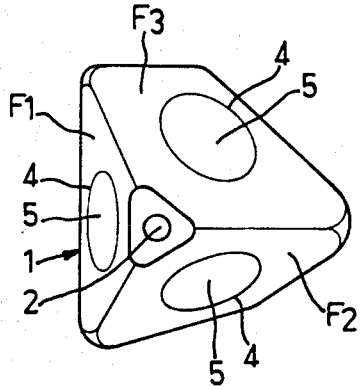
FIG. 1 is a top view of the striking head of a first form of construction of a club according to the invention, showing the three striking faces substantially defining a trihedron.
Figure 2:
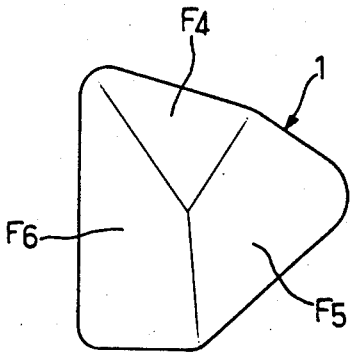
FIG. 2 is a view from below of the same striking head, showing three support faces defining a flatter trihedron.

As can be seen in particular in FIG. 1, the club head designated 1 has an external generally polyhedral shape, of the trihedron type, widening from its apex, in which an opening 2 is provided for connection to the club shaft, which is also shown at 3.

F1, F2, F3 designate the three faces of the trihedron, which are arranged so as to constitute three selectable striking faces for the ball, with different angles of inclination. The selection of the striking face is effected by simple rotation of the shaft about its own axis. Beyond its striking faces, the head also has the general shape of a relatively flat trihedron, whose faces F4, F5, F6 are adapted to serve as surfaces for supporting the head on the ground, which are suitable for the different striking faces F1, F2, F3, for a player of average height.

The head of the club is preferably of metal, for example of cast light metal, and made in the form of a hollow structure in order to be within a weight range close to that of conventional golf clubs, but capable of being modified at the will of the user by the weighting of this structure, while the shaft can for example be selected to have a length substantially equal to that of an average golf iron.

A hollow metal structure of this kind is preferably provided with openings 4 in the striking zone of each of the faces F1, F2, F3, which openings are then closed by obturators 5, preferably of an elastomer, which form ball impact members. These obturators can simply be bonded by their edges in a shouldered support socket, so as to be flush with the corresponding face of the club, while constituting a relatively flexible impact member. These obturators can also be of different colours in order to make it easier for beginners to identify the different utilization faces of the club.

Figure 3:
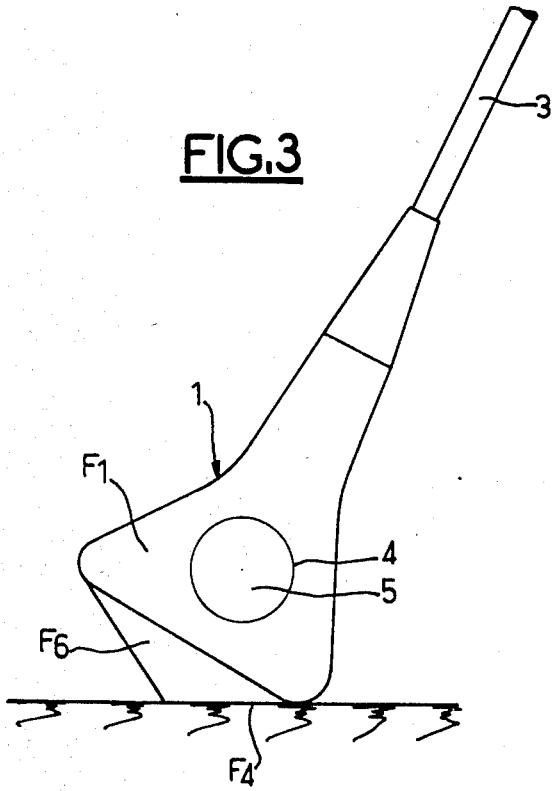
FIG. 3 is a view showing the utilization of the club illustrated in the previous Figures as a driver, making use of one of the faces for support on the ground, the starting trajectory of the ball being perpendicular to the plane of the Figure.

Thus, the four basic utilizations possible with a club of the kind illustrated in FIGS. 3 to 8 are as follows:

FIG. 3: This Figure corresponds to use as a driver (long starting shot), for which purpose the almost vertical face F1 is placed opposite the ball, while the bottom face F4 is substantially next to the ground.

Figure 4:
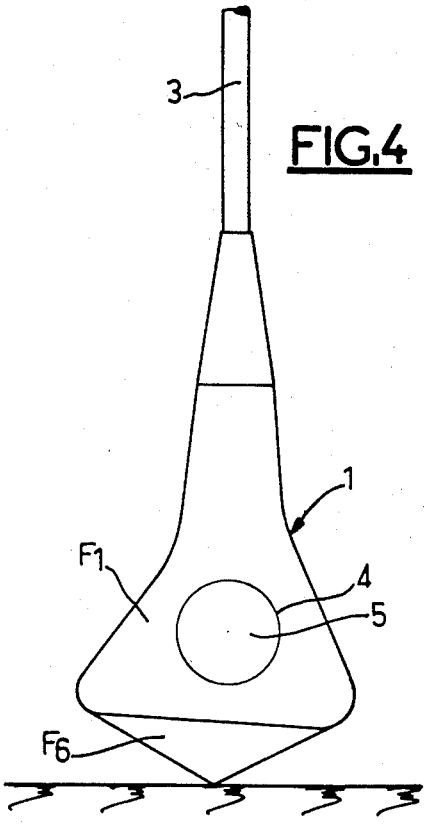
FIG. 4 is a similar view likewise taken from the front, from the ball which is to be struck, showing the use of the same striking face to cause the ball to roll, as with a putter.

FIG. 4: This Figure corresponds to use as a putter (the holding shot), for which use is once again made of the face F1, which is used with the shaft 3 held substantially vertical or slightly inclined forward relative to the ball.

Figure 5:
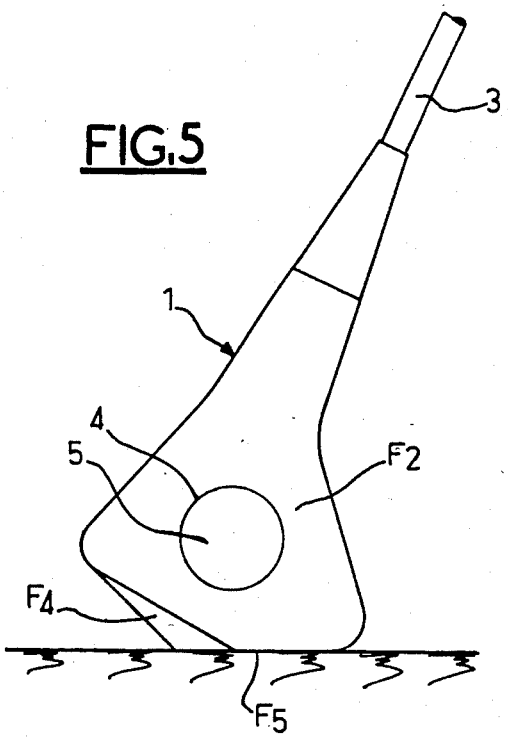
FIG. 5 is a view likewise taken from the front, from the ball which is to be struck, of the same embodiment, utilizing another face for support on the ground and the second striking face for the purpose of sending the ball a relatively great distance with the aid of a low trajectory.

FIG. 5: This Figure corresponds to use as an intermediate iron or No. 3 wood, for which the face F2, which is inclined more than the face F1, is placed opposite the ball through the rotation of the shaft of the club, in the clockwise direction, by about one-third of a turn in relation to FIG. 3, and by causing the face F5 to rest substantially on the ground in front of the ball.

Figure 6:
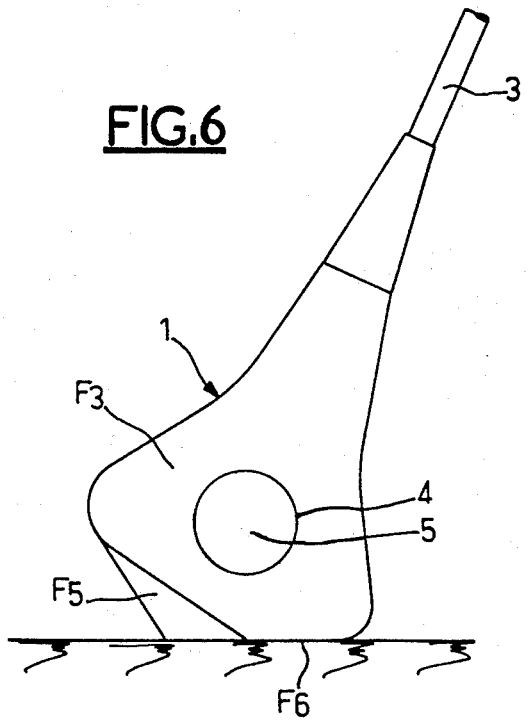
FIG. 6 is a similar view, likewise taken from the front, from the ball which is to be struck, showing the utilization of another support face and of another striking face, making it possible to send the ball a short distance with a high trajectory.

FIG. 6: This Figure corresponds to use as a small iron, for which purpose the face F3, which has an even greater inclination than the face F2, is placed opposite the ball through the rotation of the shaft of the club in the clockwise direction, by about one-third of a turn relative to FIG. 4, and by bringing the face F6 to rest on the ground in front of the ball.

Figure 7:
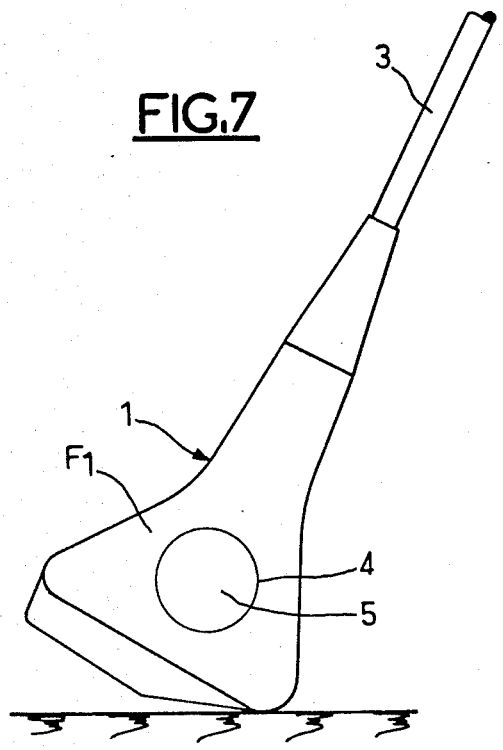
FIG. 7 is a similar view to FIG. 3, likewise taken from the front, from the ball which is to be struck, showing another way of utilizing the same club for sending the ball a great distance, as with a driver.

FIG. 7: This Figure shows another possible utilization of the club, for sending the ball a long distance by using the striking face F1 as in the case of FIG. 3. In this case the support face F4 is no longer used and the ball is preferably placed on a support so that it lies about 3 centimeters from the ground.

Figure 8:
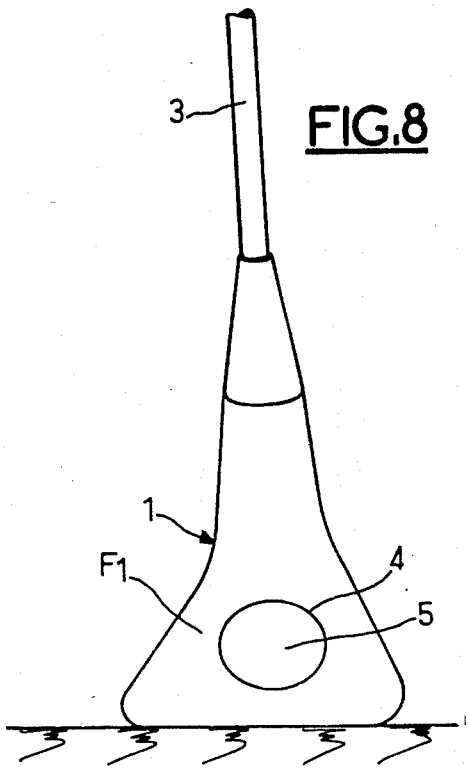
FIG. 8 is a similar view to FIG. 4, likewise taken from the front, from the ball which is to be struck, showing another way of utilizing the same striking face to cause the ball to roll, as with a putter.

FIG. 8: This Figure illustrates another possible way of causing the ball to roll, as in the case of FIG. 4, after the style of a putter, still using the striking face F1. However, in this case the support face F6 comes into contact with the ground, thus making it necessary to use the club with the shaft slightly inclined relative to the vertical, in the direction of departure of the ball. This method of holding the club after the style of a putter does not in any way hinder its use and corresponds to the habitual style of certain golfers. The striking face F1 is then substantially vertical.

FIGS. 9 and 10, in which identical elements are given the same references, illustrate a second form of construction of the club according to the invention.

In FIG. 9 can be seen once again the three striking faces F1, F2, and F3. In addition, FIG. 9 also shows the intersection edges between these faces. These edges are given the reference letter A with two indices corresponding to the two secant faces. In FIG. 9 it is therefore possible to see the edges A12, A13, and A23, all three of which intersect at the end of the shaft 3 of the club.

In FIG. 10 can be seen once again the two faces F5 and F6 for support on the ground. In this embodiment the face F4 has been eliminated. The two faces F5 and F6 for support on the ground intersect on the edge A56. It will be noted that the face F6 has an approximately rectangular general shape, while the face F5 has a triangular shape.

The different apices of the polyhedral striking head are also indicated in FIGS. 9 and 10, and are given the reference letter S with a three-digit index representing the three faces secant to these apices.

Thus, the apices S136, S126, S256, S235 and S356 can be seen in FIGS. 9 and 10.

FIG. 9 also shows the trace of the shaft 3 in the different positions of use. When the face F2 is used, the trace of the shaft is the half line M2 starting from the apex of the polyhedron. In this case the intersection between the striking face F2 and the ground, that is to say the intersection between the face F2 and the face F5 is the trace T25. For suitable utilization it is necessary for this trace T25 to be parallel to the trace M2 of the shaft.

Similarly, when the face F3 is used, the trace of the shaft 3 is the half line M3 starting from the apex of the polyhedron, which is parallel to the trace T36, which is the intersection of the striking face F3 with the face F6 for support on the ground.

The traces M2 and M3 of the shaft 3 have also been shown in FIG. 10, where they start from the fictitious point of intersection between the shaft 3 and the face F6.

When the face F1 is used as a putter, the shaft 3 is substantially vertical and the intersection of the face F1 with the face F6 is the trace T16, which is perpendicular to the trajectory of the ball.

Geometrical examination of the problem posed shows its great complexity and the difficulties which it was necessary to overcome in order to arrive at the particular shape of the striking head illustrated by way of example in FIGS. 9 and 10, which effectively permits the definition of the three striking faces desired.

It was in fact necessary for the various following geometrical constraints to be complied with simultaneously:

Definition of three striking faces F1, F2, and F3.

Definition of two faces F5, F6 for support on the ground, the two traces M2, M3 of the shaft on the ground being respectively parallel to the two edges T25 and T36 in the respective utilization of the faces F2 and F3.

The three edges A12, A13, and A23 must intersect at a real point coinciding with the end of the shaft.

The angle between the shaft and the two faces F5 and F6 for support on the ground must be substantially the same and be between 60 and 75 degrees, thus defining the angle of lie for the use of the faces F2 and F3.

The angle between the face F5 for support on the ground and the striking face F2 must be between about 65 and 55 degrees, so as to form an angle of loft of the striking face F2 between about 25 and 35 degrees.

The angle between the face F6 for support on the ground and the striking face F3 must be between about 50 and 45 degrees, so as to define an angle of loft of the striking face F3 of the order of 40 to 45 degrees.

Finally, it is appropriate that the different mathematical constraints thus imposed do not result in an irregular polyhedron. It is therefore also appropriate to introduce a minimization function making it possible to ensure that the lengths of the different edges thus defined will be as little different from one another as possible.

The present invention represents the result of these considerations and, as has been seen, makes it possible to obtain the three striking faces having different inclinations, and the suitable orientation of the striking edges and the faces for support on the ground.

FIGS. 11*a* and 11*b* show the use of the club for sending the ball a great distance after the style of a driver. The ball 6 has been placed on a support or tee 7 driven into the ground in such a manner that the ball is situated about 3 centimeters from the ground. In this utilization the substantially vertical striking face F1 comes into contact with the ball 6. It can be seen in FIGS. 11*a* and 11*b* that the lie is about 55 degrees and the loft about 10 degrees.

It will be noted in FIGS. 11*a* to 14*b* that the end of the shaft 3 is enclosed in a socket 3*a* matching the shape of the different striking faces F1, F2 and F3. The edges A12, A13 and A23 are joined to this socket by curvilinear portions. A construction of this kind, improving the strength of the fastening of the shaft and the appearance of the club, does not in any way modify its structure. It can be seen in particular that the extensions of the edges A12, A13 and A23 intersect well inside the socket 3*a*, at the end of the shaft 3.

FIGS. 12*a* and 12*b* show the utilization of the same striking face F1 for causing the ball 6 to roll after the style of a putter. In this case use is made of the face F6 supported on the ground. As can be seen in FIG. 12*b*, the shaft 3 is slightly inclined relative to the vertical, in the direction of the trajectory of the ball. The face F1 is substantially vertical. The trace T16 is perpendicular to the trajectory of the ball.

FIGS. 13*a* and 13*b* show the utilization of the club for sending the ball a medium distance, by imparting to it a low trajectory as with a No. 3 wood or an intermediate iron, using the face F2 as the striking face. The face F5 rests on the ground. The trace T25 visible in FIGS. 9 and 10 is parallel to the projection of the shaft on the ground (trace M2), that is to say perpendicular to the trajectory of the ball 6. In this utilization, as illustrated, the lie is about 65 degrees and the loft about 31 degrees.

In FIGS. 14*a* and 14*b* the club is used for sending the ball a short distance with a high trajectory as with a No. 9 iron. The face F3 is used as the striking face. The trace T36 is parallel to the projection M3 of the shaft 3 on the ground, that is to say perpendicular to the trajectory of the ball. The face F6 rests on the ground, as was already the case in the utilization illustrated in FIGS. 12*a* and 12*b*. In this case, however, the striking edge is the edge T36 and no longer the edge T16.

As can be seen in the Figures, in the example illustrated, the lie is about 70 degrees and the loft about 45 degrees.

What is claimed is:

1. A golf club for instruction or recreation, comprising a shaft having one end fixedly secured to a ball striking head of generally polyhedral shape widening out from the shaft, said head having a plurality of striking faces which have different angles of inclination and can be selected by simply turning the shaft, wherein the striking head has three striking faces widening out in trihedral form from an apex on which the shaft of the club is fixed, the three faces intersecting at three edges which intersect themselves at said one end of the shaft.

2. A club as claimed in claim 1, wherein the striking head has at least two substantially flat faces for support on the ground, which are separated by at least one edge and extend beyond the said striking faces.

3. A club as claimed in claim 2, wherein the said support faces are such that the shaft forms an angle between 60 and 75 degrees relative to a horizontal plane when the support faces are respectively in contact with the ground.

4. A club as claimed in claim 2, wherein the first striking face has an angle of backward slope, relative to the vertical passing through the shaft, of between 8 and 12 degrees, the second face having an angle of backward slope of between 25 and 35 degrees, and the third striking face has an angle of backward slope of between 40 and 45 degrees, when the faces for support on the ground respectively associated therewith are in contact with the ground.

5. A club as claimed in claim 4, wherein, when a given support face is in contact with the ground, the intersection between a striking face and the given support face is substantially parallel to the trace of the shaft projected on the ground.

6. A club as claimed in claim 2, wherein one of the support faces is disposed in such a manner that a first said striking face is substantially vertical when a said support face is in contact with the ground.

7. A club as claimed in claim 2, wherein one of the support faces is in contact with the ground both when the third striking face is used and when the first striking face is used.

8. A golf club for instruction or recreation, comprising a shaft and a ball striking head of generally polyhedral shape widening out from the shaft and having a plurality of striking faces which have different angles of inclination and can be selected by simply turning the shaft, wherein the striking head has three striking faces widening out in trihedral form from an apex on which the shaft of the club is fixed, the three faces being separated by three edges which intersect at the end of the shaft integral with the striking head, said striking head having at least two support faces for support on the ground, said support faces extending beyond the striking faces and being separated by at least one edge, said support faces being oriented where the shaft forms an angle between 60 and 70 degrees relative to a horizontal plane when the support faces are respectively in contact with the ground, one of said support faces having a substantially triangular shape, while the other support face has a substantially rectangular shape.

9. A club as claimed in claim 8, wherein the angle of the shaft relative to the horizontal is substantially the same when the two support faces are respectively in contact with the ground.

10. A club as claimed in claim 8, wherein the first striking face has an angle of backward slope, relative to the vertical passing through the shaft, of between 8 and 12 degrees, the second face having an angle of backward slope of between 25 and 35 degrees, and the third striking face has an angle of backward slope of between 40 and 45 degrees, when the faces for support on the ground respectively associated therewith are in contact with the ground.

11. A golf club for instruction or recreation, comprising a shaft and a ball striking head of generally polyhedral shape widening out from the shaft and having a plurality of striking faces which have different angles of inclination and can be selected by simply turning the shaft, wherein the striking head has three striking faces widening out in trihedral form from an apex on which the shaft of the club is fixed, the three faces being separated by three edges which intersect at the end of the shaft integral with the striking head, said striking head having three support faces for support on the ground, said support faces extending beyond the striking faces and being separated by edges, said support faces forming a flat trihedron shape extending beyond said striking faces.

12. A club as claimed in claim 11, wherein the said support faces are such that the shaft forms an angle between 60 and 75 degrees relative to a horizontal plane when the support faces are respectively in contact with the ground.

13. A club as claimed in claim 11, wherein the angle of the shaft relative to the horizontal is substantially the same when the two support faces are respectively in contact with the ground.

14. A club as claimed in claim 11, wherein the first striking face has an angle of backward slope, relative to the vertical passing through the shaft, of between 8 and 12 degrees, the second face having an angle of backward slope of between 25 and 35 degrees, and the third striking face has an angle of backward slope of between 40 and 45 degrees, when the faces for support on the ground respectively associated therewith are in contact with the ground.

15. A golf club for instruction or recreation, comprising a shaft and a ball striking head of generally polyhedral shape widening out from the shaft and having a plurality of striking faces which have different angles of inclination and can be selected by simply turning the shaft, wherein the striking head has three striking faces widening out in trihedral form from an apex on which the shaft of the club is fixed, the three faces being separated by three edges which intersect at the end of the shaft integral with the striking head, said striking head having at least two substantially flat support faces for support on the ground, said support faces extending beyond the striking faces and being separated by at least one edge, said support faces being oriented where the shaft forms an angle between 60 and 75 degrees relative to a horizontal plane when the support faces are respectively in contact with the ground, said shaft being at an angle to the ground which is substantially the same when the two support faces are respectively in contact with the ground.

16. A club as claimed in claim 15, wherein the striking head has three faces for support on the ground which have a flatter trihedron shape extending beyond the said striking faces.

17. A club as claimed in claim 15, wherein the first striking face has an angle of backward slope, relative to the vertical passing through the shaft, of between 8 and 12 degrees, the second face having an angle of backward slope of between 25 and 35 degrees, and the third striking face has an angle of backward slope of between 40 and 45 degrees, when the faces for support on the ground respectively associated therewith are in contact with the ground.

* * * * *